US006095208A

United States Patent [19]

Aguilar et al.

[11] Patent Number: 6,095,208

[45] Date of Patent: Aug. 1, 2000

[54] PALLET NOTCHER

[76] Inventors: Buster L. Aguilar, 612 W. Boone Ave., Nampa, Id. 83651; Donald R. Bently, 4312 S. Rimview Way, Boise, Id. 83716; James D. Hambleton, 619 Winther Blvd., Nampa, Id. 83651

[21] Appl. No.: 09/353,334

[22] Filed: Jul. 14, 1999

Related U.S. Application Data

[60] Provisional application No. 60/132,402, Apr. 27, 1999.

[51] Int. Cl.[7] ..... B27C 5/00

[52] U.S. Cl. ..... 144/133.1; 144/2.1; 144/3.1; 144/134.1; 144/136.1; 144/218; 144/363

[58] Field of Search ..... 144/1.1, 2.1, 3.1, 144/82, 87, 136.1, 363, 368, 218, 134.1

[56] References Cited

U.S. PATENT DOCUMENTS

| | | | |
|---|---|---|---|
| 3,735,787 | 5/1973 | Siel | 144/133.1 |
| 4,132,253 | 1/1979 | Mills | 144/133.1 |
| 4,223,708 | 9/1980 | Paris, Jr. et al. | 144/133.1 |
| 4,319,931 | 3/1982 | Mills | 144/133.1 |

*Primary Examiner*—W. Donald Bray
*Attorney, Agent, or Firm*—Craig M. Korfanta; Joseph W. Holland

[57] ABSTRACT

A pallet notching device for notching assembled pallets including a frame having a motive force device connected to the frame for driving a pair of vertically oriented rotating drive shafts and a blade assembly removably attachable to each shaft for rotation in a horizontal plane. The device may include an feed conveyor or mechanism for automatically feeding assembled pallets through the rotating cutter heads and directing and conveying the notched pallets away from the notch cutting heads. Each rotating cutter assembly may include a plurality of blades each having a generally circular configuration and a plurality of cutting teeth mounted about the periphery of the blade. The plurality of blades are mounted on a vertical spindle and driven by a motor. The plurality of blades may be configured so that the diameter of the top several blades each have a decreasing diameter and a radiused profile. This configuration provides a rounded corner for the notch.

10 Claims, 7 Drawing Sheets

PALLET NOTCHER

RELATED APPLICATIONS

This application claims the priority of Provisional Application Ser. No. 60/132,402 entitled PALLET NOTCHER, filed Apr. 27, 1999.

BACKGROUND

1. Technical Field

This invention relates generally to machinery for producing finished wood products and more specifically to a device including a rotating cutter assembly for notching pallet stringers.

2. Background of the Invention

Pallets are used in a variety of industries as a relatively low cost means for stacking, storing and handling raw materials and manufactured and bulk goods. A pallet typically includes series of top deckboards which are nailed to a the upper surface of a series of substantially parallel and equally spaced stringers, typically three, two side or end stringers and a center stringer. Several lower deckboards are then nailed to the lower surface of the stringers to provide the required rigidity to the pallet assembly. Both the upper deck boards and the lower deckboards are nailed to the stringers so that the longitudinal axes of the deckboards are substantially perpendicular to the longitudinal axes of the stringers.

The stringers may be fabricated from dimensional lumber which is sized and oriented to allow adequate spacing between the upper and lower deckboards of the pallet to permit the tine of a fork lift or other lift mechanism to be inserted between the upper and lower deckboards. For example, if the stringer is manufactured from two inch by four inch lumber, (two-by-four), the stringer would be oriented so that the upper and lower deckboards would be nailed to the side having the two inch dimension, allowing a spacing between the upper and lower deckboards of four inches.

A two-way pallet permits access by the lifting mechanism from the front or rear of the pallet. The tines of the lifting mechanism are insertable between and more or less parallel to the stringers. A four-way pallet permits access by the lifting mechanism from the front, rear or sides of the pallet. The tines of the lifting mechanism may be inserted between the stringers or in the alternative, the tines of the lifting mechanism may be inserted through a pair of notches through the face of each stringer. Each stringer has a corresponding pair of notches allowing the tines to be inserted from either side of the pallet and under substantially the full width of the pallet.

A four-way pallet is constructed by notching the stringers with a notching machine prior to assembly of the pallet. The industry's standard dimensions for notches are one and one-half inches high by nine inches wide. Following notching, the stringers are placed in a jig or an automatic pallet manufacturing machine where the top and bottom deckboards are nailed to the stringers with an automatic air driven nail gun. A considerable number of stringers are broken at the reduced cross section of the notch during the manufacturing process due to a combination of reduced strength of the stringer and the force of the nail gun piston that is required to drive and set the nails with a single stroke. It would, therefore, be desirable from a cost standpoint to notch the stringer after the pallet has been assembled.

Heretofore, the step of notching the stringers must occur prior to assembly and nailing of the pallet. The notching operation requires the stringers to be hand loaded onto a feed chain mechanism to convey them across the notch cutters to form the notch. Stringers are stacked face to face to provide backing to the two-by-four being cut to hold tearout to a minimum. After the notching operation the stringers are restacked and delivered to a pallet assembly area.

Stringers are next placed in a jig or a pallet assembly machine so the top and bottom deckboards can be nailed in place. Automatic nail machines must operate at very high pressures to insure that each nail is completely set in one stroke. Some stringers will break when a nail is driven into the two-by-four at the reduced cross section of the notch thus requiring the pallet to be removed from the automatic assembly and stacking machine, often retained for repair or salvage. Considerable labor and materials must be expended to replace the broken stringers.

Presently, notching is achieved using a rotating cutter assembly having a plurality of blades each having a plurality of cutting teeth mounted about the periphery of the blade. The plurality of blades are mounted on a horizontal shaft driven by a motor so that the blades rotate in a vertical plane. This configuration has not been demonstrated as being suitable for notch cutting assembled pallets as the vertically rotating blades have a distinct tendency to cause tear-outs at the backside of the notch upon completion of the cut. Tear-outs further reduce the strength of the stringer by creating additional stress risers in the already weakened region of the notch. This propensity to cause tear-outs can be reduced by providing a backing for each stringer being cut. This is done by stacking the stringers in the notch cutter, hence the prospect of notch cutting assembled pallets has not been practical to date.

Therefore, it would be desirable to provide an alternate method and device for pallet manufacture which would eliminate the requirement to notch cut stringers prior to pallet assembly, thereby reducing stringer breakage and overall pallet assembly costs.

SUMMARY OF THE INVENTION

A pallet notcher including a rotating cutter head for notching pallet stringers may include an infeed conveyor or mechanism for automatically feeding assembled pallets through the rotating cutter heads and an outfeed conveyor or mechanism for directing and conveying the notched pallets away from the notch cutting heads. The rotating cutter assembly may include a plurality of blades each having a generally circular configuration and a plurality of cutting teeth mounted about the periphery of the blade. The plurality of blades are mounted on a vertical spindle and driven by a motor. The plurality of blades may be configured so that the diameter of the top several blades each have a decreasing diameter. This configuration provides a rounded corner for the notch.

The infeed mechanism may include a pair of chain drives to engage an un-notched pallet and advance it through the cutting heads. The infeed mechanism may also include one or more tensioned pallet hold down assemblies and/or tensioned pallet alignment assemblies. Similarly, the outfeed mechanism may include a pair of chain drives which engage the pallet for directing and conveying the notched pallets away from the notch cutting heads.

Un-notched assembled pallets are placed on the infeed mechanism with the two-by-four stringers perpendicular to the direction of travel. Chain lugs or dogs engage a pallet and convey the pallet along a support mechanism, such as a table or a plurality of rails, toward the cutter heads. The pallet advances onto a cutting surface or table through which the rotating cutter heads project. The chain drive continues to advance the pallet against the rotating cutter heads until notch cutting is complete. During cutting, the pallet is restricted from movement in a vertical axis by a pair of edge hold down assemblies and a pair of center hold down assemblies. The hold down assemblies are configured to provide adequate hold down pressure on the pallet regardless of slight variations in thickness of the assembled pallets. A pair of side centering assemblies are configured to center the pallet during the notch cutting operation regardless of slight variations in width of the assembled pallets.

The rotating cutter heads substantially reduce the tendency to cause tear-outs at the backside of the notch upon completion of the cut, thereby making notch cutting of assembled pallets practical.

The apparatus can be integrated into an assembly line, usually as the final step in the manufacturing process, or it can be used as a stand alone device.

Other advantages will become apparent to those skilled in the art from the following detailed description read in conjunction with the appended claims.

Figure 1:
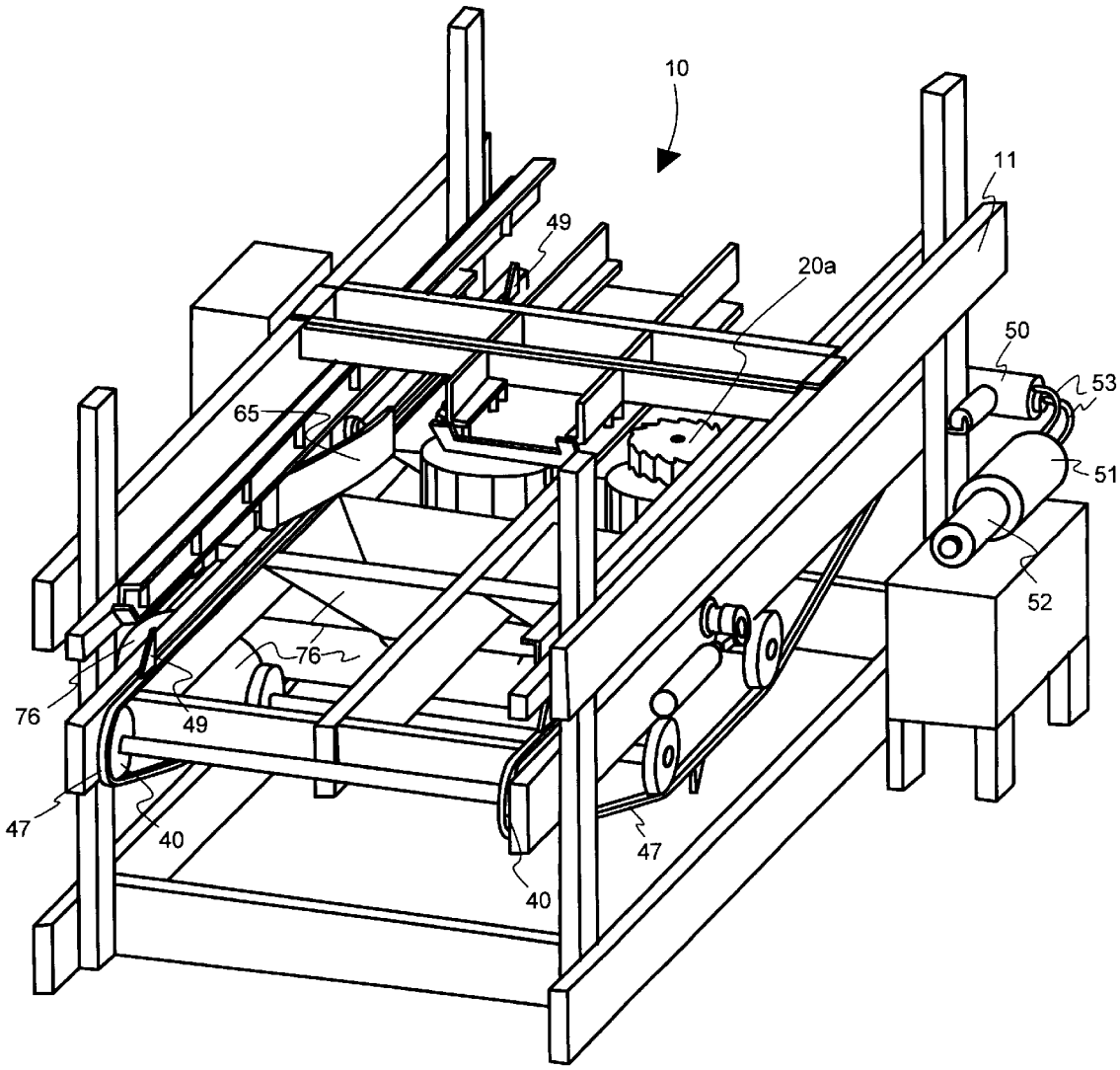
FIG. 1 is a representational view of a pallet notcher according to one embodiment of the invention.
Figure 2:
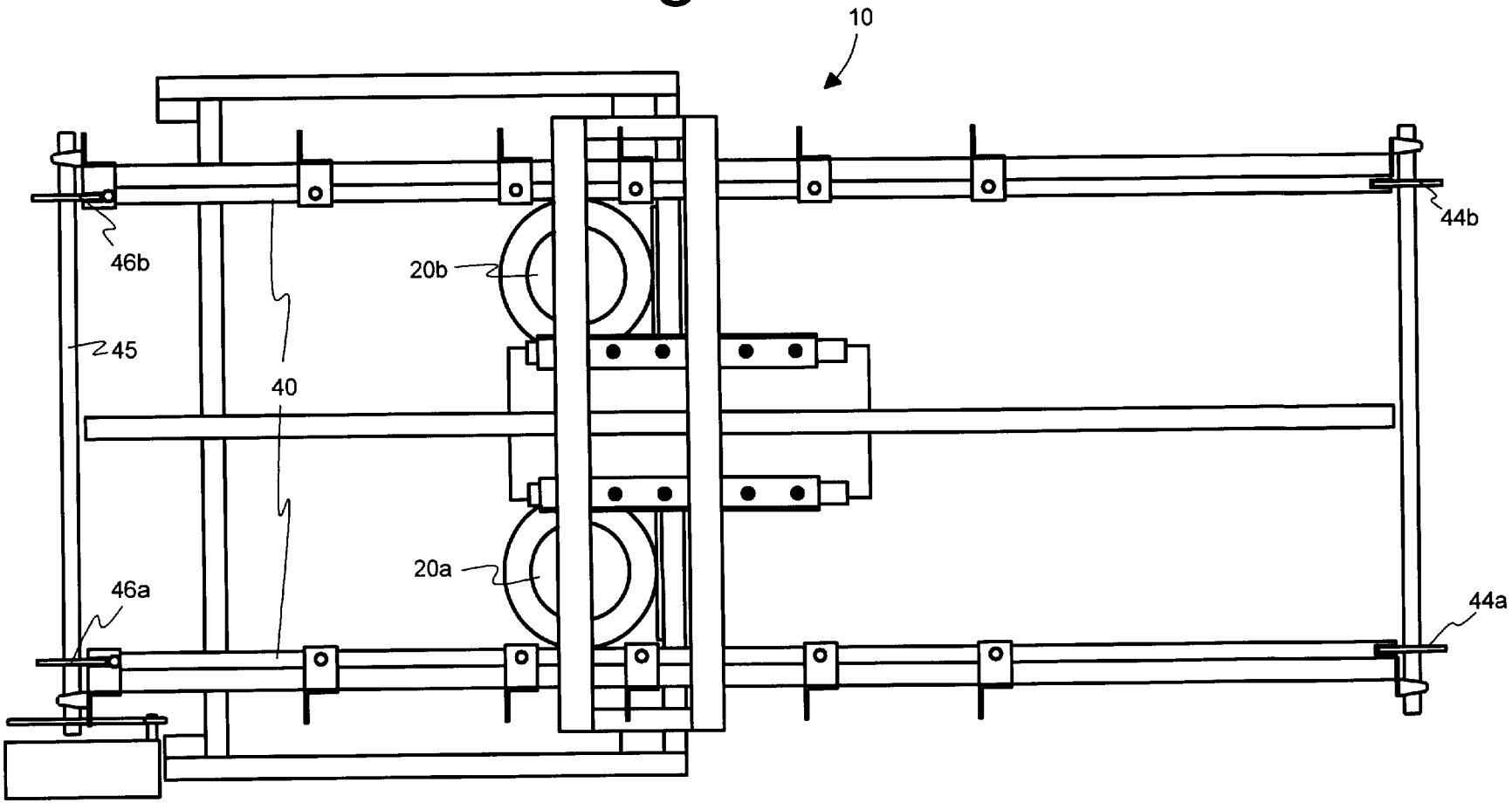
FIG. 2 is a representational top view of a pallet notcher according to one embodiment of the invention.
Figure 3:
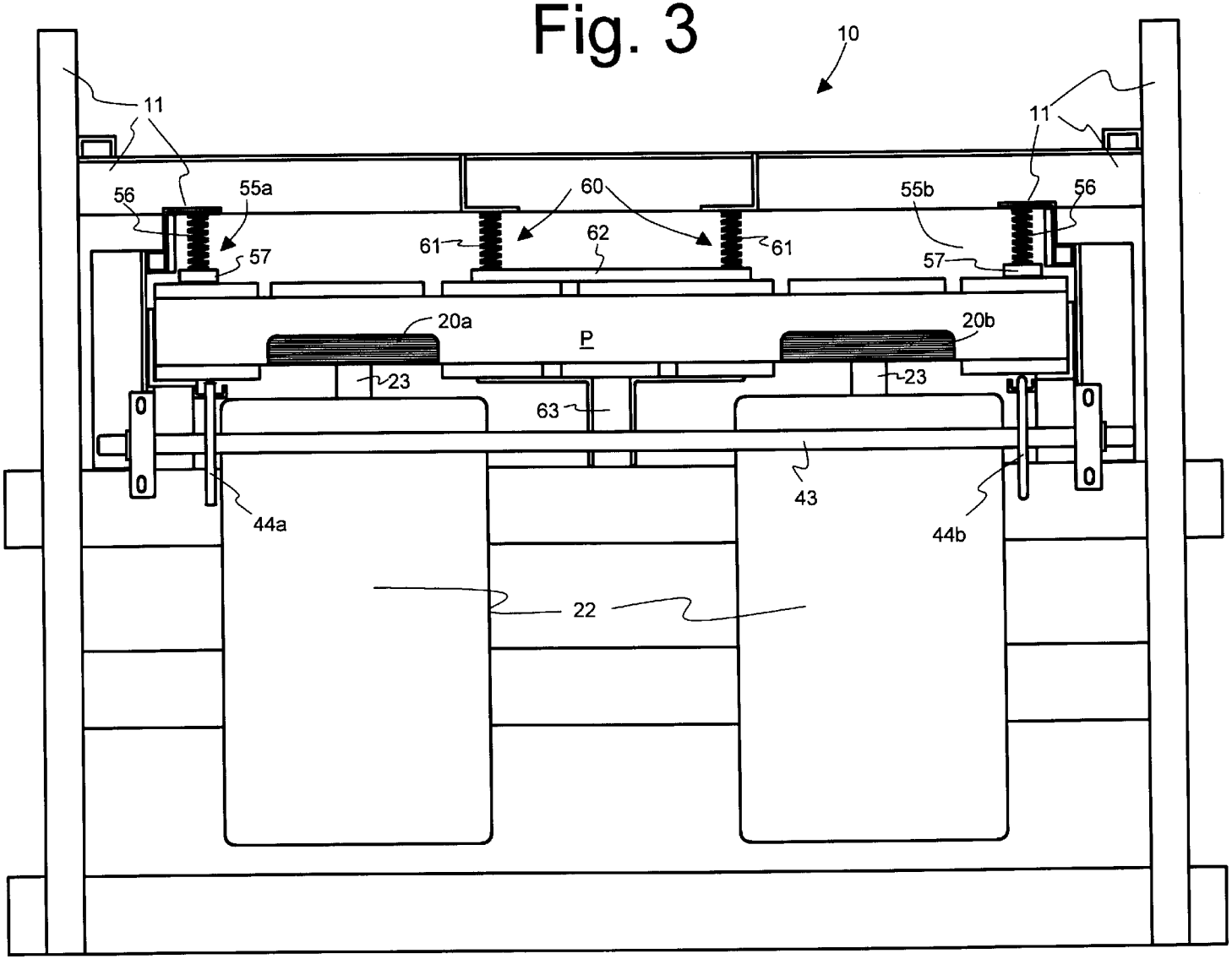
FIG. 3 is a representational back end view of a pallet notcher according to one embodiment of the invention.

It should be understood that the referenced drawings are not to scale and are intended as representations. The drawings are not necessarily intended to depict all of the functional and structural details of the invention, which can be determined by one of skill in the art by examination of the descriptions and claims provided herein.

DETAILED DESCRIPTION OF THE INVENTION

Referring to the figures pallet notcher 10 will be more completely described. Referring to the figures, pallet notcher 10 includes first cutter head assembly 20*a* and second cutter head assembly 20*b* mounted in frame 11. First cutter head assembly 20*a*, typical of both first cutter head assemblies 20*a* and 20*b*, may include blade package 21 removably mountable to cutter head motor 22 on a vertically oriented motor shaft 23. Cutter head motor 22 has, in this embodiment, the capacity of turning in the range of 3600–5000 rpm under operating loads. One model employed in the present invention is available through Toshiba, model number 80252FLG3UM, 30 hp.

Figure 4:
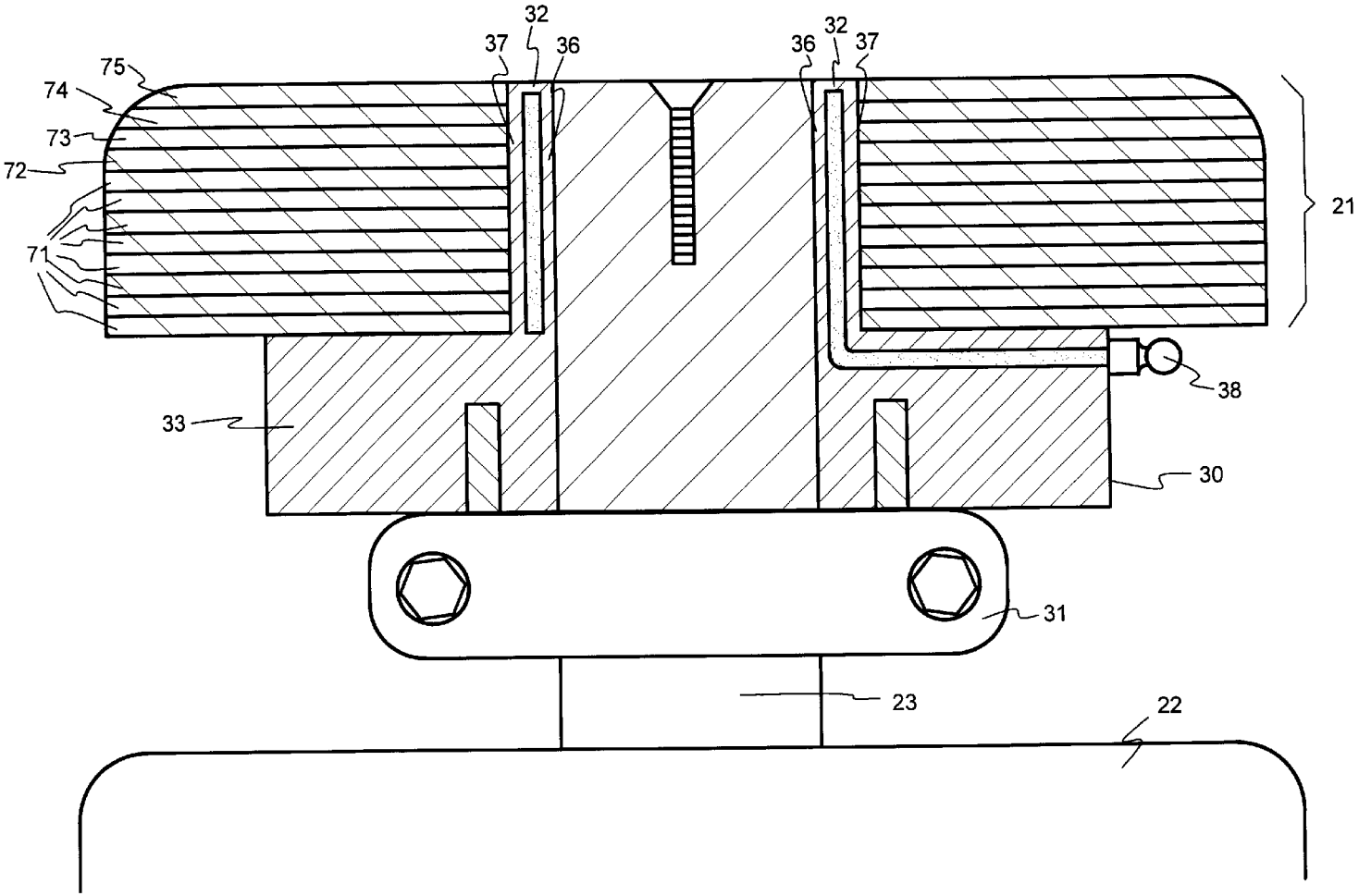
FIG. 4 is a representational side view in partial section of a cutter head assembly according to one embodiment of the invention.
Figures 5A, 5B:
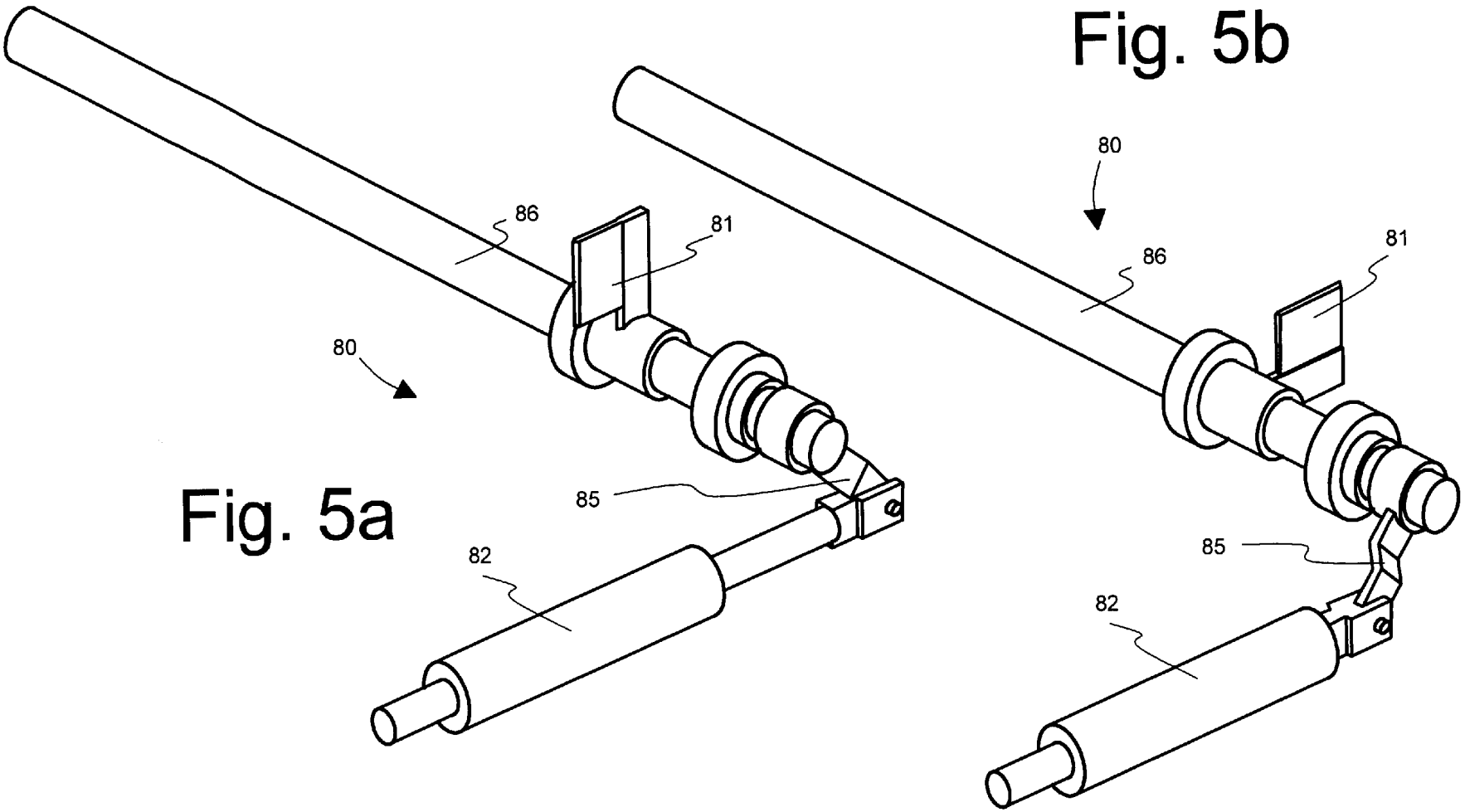
FIG. 5*a* is a representational view of a notch scoring assembly in the scoring position according to one embodiment of the invention.
FIG. 5*b* is a representational view of a notch scoring assembly in the dormant or inactive position according to one embodiment of the invention.
Figure 6A:
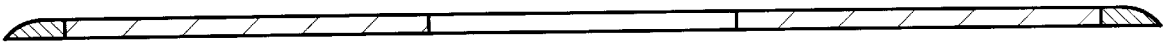
FIG. 6*a* is a side sectional view of an individual cutting blade according to the invention.
Figure 6B:
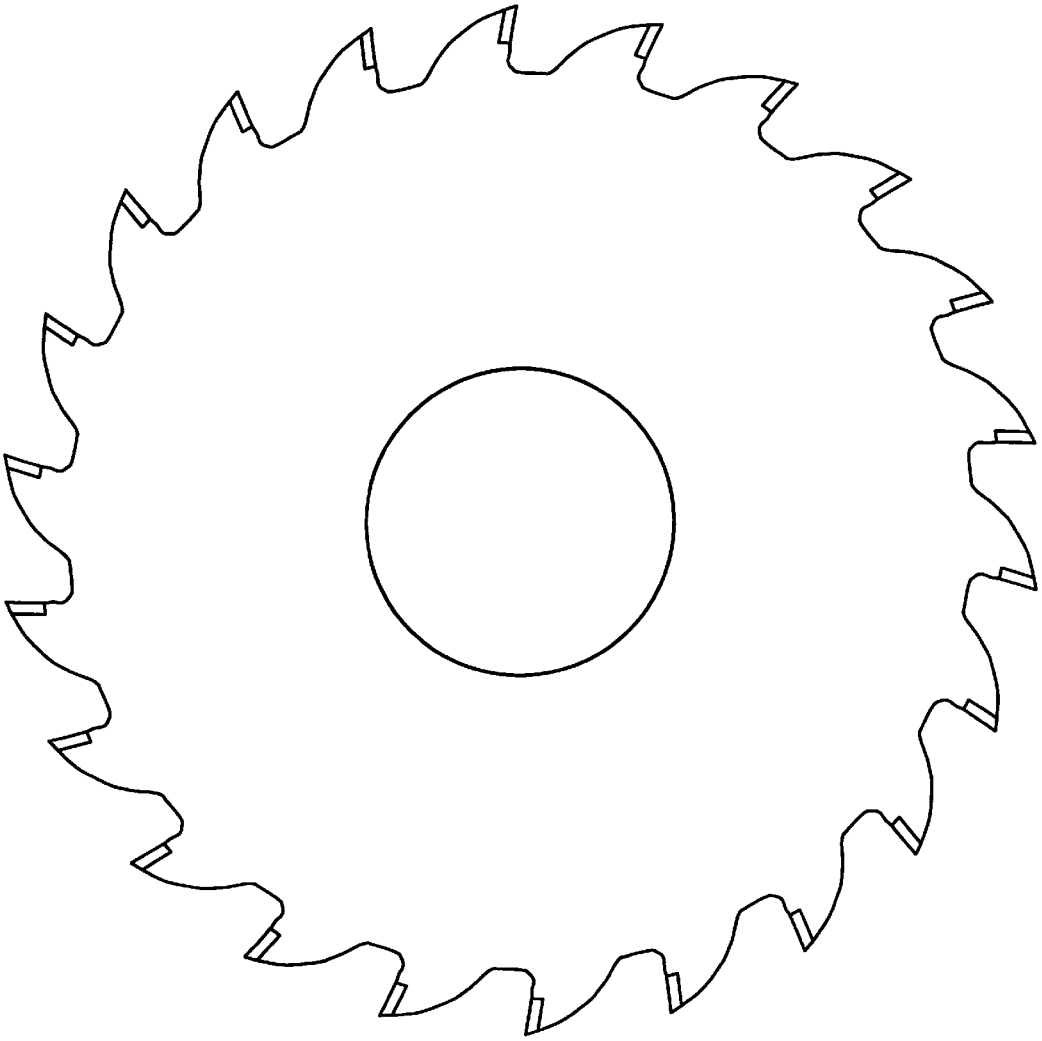
FIG. 6*b* is a top plan view of an individual cutting blade according to the invention.
Figure 7:
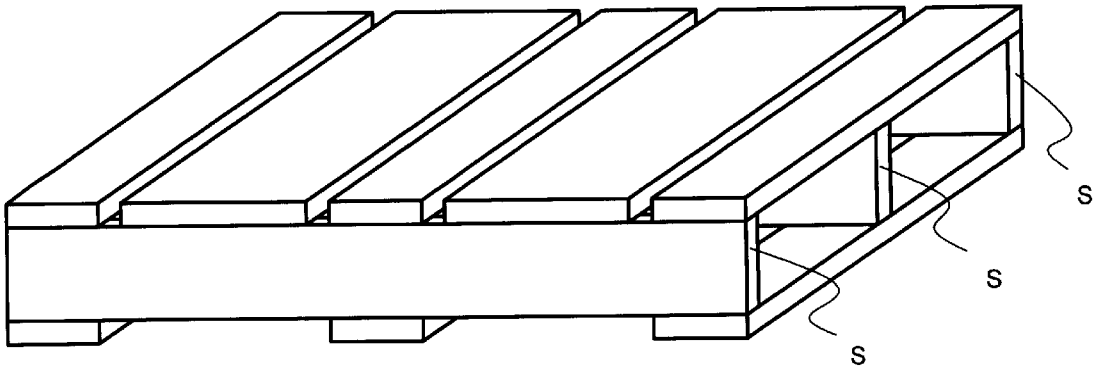
FIG. 7 is a side representational view of a two-way pallet.
Figure 8:
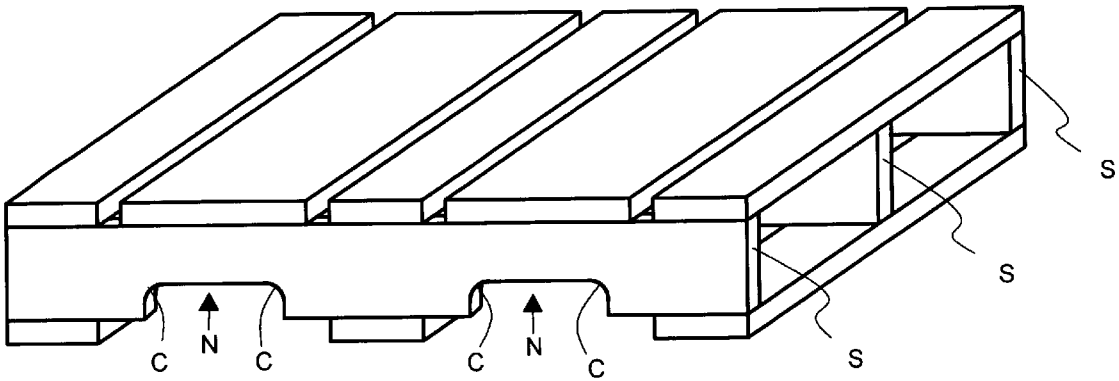
FIG. 8 is a side representational view of a four-way pallet.

Blade package 21 may include a first plurality of rotating blades shown as lower blades 71 removably mountable on vertically oriented motor shaft 23. Blade package 21 may also include a second plurality of rotating blades shown as upper radiused blades 72, 73, 74, and 75 removably mountable on vertically oriented motor shaft 23. Radiused blades 72–75 are removably mountable on the vertically oriented motor shaft 23 above lower blades 71. FIGS. 4, 6*a* and 6*b* illustrate the general plan and profile views for radius blades 72–75. In one embodiment of the invention, there are eight separate lower blades 71 each configured having an effective cutting diameter of nine inches in diameter and twenty-two cutting teeth. In one embodiment of the invention, first radius blade 72 has twenty-two teeth, an average effective cutting radius of nine inches and a radiused profile. In this embodiment of the invention second radius blade 73 has twenty-two cutting teeth, an average effective cutting diameter of 8.968 inches and a radiused profile while third radius blade 74 has twenty-two cutting teeth, an average effective cutting diameter of 8.866 inches and a radiused profile. In this embodiment of the invention fourth radius blade 75 has twenty-two cutting teeth, an effective cutting diameter of 8.661 inches and a radiused profile. When first radius blades 72–75 are assembled in blade package 21, this configuration permits notch N in pallet P to be cut having radiused corner C.

In one embodiment of the invention individual blades are first mounted on hydrolock 30 which removably mounts to collar 31, which itself is secured to motor shaft 23. One model of hydrolock employed in the present invention is available through ETP, model No. ETPA1 13/16 65/65. Hydrolock 30 includes sleeve 32 extending from flange 33. Each of the plurality of rotating blades may be configured having a center aperture sized to allow the blade to be removably mounted over sleeve 32. Sleeve 32 is configured having inner wall 36 and outer wall 37. Pressure zirk 38 permits a highly pressurized fluid, such as grease, to be injected between inner wall 36 and outer wall 37 causing outer wall 37 to expand against inside face 36 of center aperture of each of the blades and inner wall 36 to expand against shaft 23. This force is sufficient to lock blades against to shaft 23 during operation.

Pallet notcher 10 may also include conveyor assembly 40. Conveyor assembly 40 may include drive shaft 43 having right drive sprocket 44*a* and left drive sprocket 44*b* and front shaft 45 having right front sprocket 46*a* and left front sprocket 46*b*. Drive chains 47, each having dogs 49 attached thereto, are driven by hydraulic drive motor 50. Hydraulic drive motor 50 is fluidly connected to hydraulic pump 51 and hydraulic reservoir 52 by hydraulic lines 53.

Pallet notcher 10 may also include first side hold down assembly 55*a* and second side hold down assembly 55*b* having springs 56 attached between frame 11 and flat bar 57. Center hold down assembly 60 may include springs 61 attached between frame 11 and plate 62. First side hold down assembly 55*a* and second side hold down assembly 55*b* and center hold down assembly 60 work in combination to keep pallet P flat and secure against table 63 during the notch cutting operation.

Opposing centering assemblies 65 work in conjunction to keep pallet P centered with respect to table 63 during the notch cutting operation. Each centering assembly 65 may include a spring attached between frame 11 and itself to center bias an extending portion of the assembly. A facing material may be secured to the face of each centering assembly can be made of a high modulus plastic such as ultra-high-molecular-weight-polyethylene to facilitate the smooth transfer of pallet P across the faces of the centering assemblies and through pallet notcher 10.

Pallet notcher controls, not shown, are operatively connected to various component parts of pallet notcher 10 including cutter head motors 22 to control motor speed and to hydraulic drive motor 50, to control the travel speed of pallet P through pallet notcher 10. Pallet notcher 10 may also include vacuum 76 for removing sawdust during the cutting operation.

Pallet notcher 10 may also include one or more scoring blades such as those present in scoring blade assembly 80. In some applications such as a food grade pallet, a substantially burr free cut is required on the pallet. This can be aided by pre-scoring. Scoring blade assembly 80, including scoring blades 81 only one of which is shown, are operated by a pneumatic cylinder 82 to score the front face F of stringer S as pallet P advances along table 63 prior to reaching cutter head assemblies 20*a* and 20*b*. Connecting arm 85 is operatively connected between shaft 86 and pneumatic cylinder 82. A sensor, such as an optical sensor or camera may be positioned above table 63 to sense the advance of pallet P to a preselected point. At this point the pallet notcher controller 25 signals actuation of pneumatic cylinder 82 which in turn causes shaft 86 to rotate. This causes scoring blades 81 to strike the front face F of stringer S.

In use, pallet P is placed on table 63 of pallet notcher 10, either manually or by automatic placing equipment (not shown). Hydraulic motor 50 attached to drive shaft 43 turns right drive sprocket 44*a* and left drive sprocket 44*b* advancing chains 47 in the direction of cutter head assemblies 20*a* and 20*b*. Dogs 49 engage pallet P moving pallet P along conveyor assembly 40. Right hold down assembly 55*a* and left hold down assembly 55*b* engage pallet P along the top peripheral edges holding pallet P securely against conveyor assembly 40 and table 63. As pallet P advances along conveyor assembly 40, the front edge of pallet P engages center hold down assembly 60 which assists in securing pallet P against conveyor assembly 40 and table 63.

Centering assemblies 65 assist in centering pallet P on table 63 and with respect to first cutter head assembly 20*a* and second cutter head assembly 20*b*. Conveyor assembly 40 continues to advance pallet P across table 63 against first cutter head assembly 20*a* and second cutter head assembly 20*b* cutting notches in each stringer of pallet S.

While this invention has been described with reference to the described embodiments, this is not meant to be construed in a limiting sense. Various modifications to the described embodiments, as well as additional embodiments of the invention, will be apparent to persons skilled in the art upon reference to this description. It is therefore contemplated that the appended claims will cover any such modifications or embodiments as fall within the true scope of the invention.

We claim:

1. An apparatus for cutting opposing notches in a workpiece comprising:

a frame;

a motive force device connected to the frame for driving a pair vertically oriented rotating drive shafts:

a rotating cutter head removably attachable to each vertically oriented rotating drive shaft for rotation by the vertically oriented rotating drive shafts in a horizontal plane wherein each of the rotating cutter heads includes a first plurality of rotating blades mounted on the vertically oriented rotating drive shaft, each of the first plurality of rotating blades having a substantially equal effective cutting diameter; and a second plurality of rotating blades mounted on the vertically oriented rotating drive shaft, each of the second plurality of rotating blades having a decreasing effective cutting diameter;

an feed mechanism operatively associated with the frame for feeding a workpiece past the rotating cutter heads; and wherein the motive force device connected to the frame for driving a vertically oriented rotating drive shafts comprises an electric motor.

2. The apparatus for cutting opposing notches of claim 1 wherein second plurality of rotating blades further comprise:

a first radius blade having a radiused profile and an effective cutting diameter equal to that of the blades in the first plurality of blades;

a second radius blade having a radiused profile and an effective cutting diameter less than that of the first radius blade;

a third radius blade having a radiused profile and an effective cutting diameter less than that of the second radius blade; and a fourth radius blade having a radiused profile and an effective cutting diameter less than that of the third radius blade.

3. An apparatus for cutting opposing notches in a workpiece comprising:

a frame;

a motive force device connected to the frame for driving a pair of vertically oriented rotating drive shafts;

a rotating cutter head removably attachable to each vertically oriented rotating drive shaft for rotation by the vertically oriented rotating drive shafts in a horizontal plane;

a feed mechanism operatively associated with the frame for feeding a workpiece past the cutter heads; and a scoring blade assembly positioned before the cutter heads.

4. The apparatus for cutting opposing notches of claim 3 wherein the scoring blade assembly comprises:

a shaft;

a scoring blade radially attached to the shaft; and a rotational displacement device operatively connected to the shaft.

5. The apparatus for cutting opposing notches of claim 3 wherein the motive force device connected to the frame for driving vertically oriented rotating drive shafts comprises an electric motor.

6. The apparatus for cutting opposing notches of claim 3 wherein the rotating cutter heads each comprise:

a first plurality of rotating blades mounted on the vertically oriented rotating drive shafts, each of the first plurality of rotating blades having a substantially equal effective cutting diameter;

a second plurality of rotating blades mounted on the vertically oriented rotating drive shafts, each of the blades of the second plurality of rotating blades having a decreasing effective cutting diameter.

7. The apparatus for cutting opposing notches of claim 6 wherein second plurality of rotating blades further comprise:

a first radius blade having a radiused profile and an effective cutting diameter equal to that of the blades in the first plurality of blades;

a second radius blade having a radiused profile and an effective cutting diameter less than that of the first radius blade;

a third radius blade having a radiused profile and an effective cutting diameter less than that of the second radius blade; and a fourth radius blade having a radiused profile and an effective cutting diameter less than that of the third radius blade.

8. The apparatus for cutting notches of claim 3 wherein each cutter head comprises a plurality of rotating blades wherein each of the plurality of rotating blades has an offset tooth configuration.

9. A blade assembly for cutting notches in a workpiece comprising:

a first plurality of rotating blades mountable on a vertically oriented rotating drive shaft, each of the first plurality of rotating blades having a substantially equal effective cutting diameter; and a second plurality of rotating blades mounted on the vertically oriented rotating drive shaft, each of the second plurality of rotating blades having a decreasing effective cutting diameter.

10. The blade assembly for cutting notches of claim 9 wherein second plurality of rotating blades further comprises:

a first radius blade having a radiused profile and an effective cutting diameter equal to that of the blades in the first plurality of blades;

a second radius blade having a radiused profile and an effective cutting diameter less than that of the first radius blade;

a third radius blade having a radiused profile and an effective cutting diameter less than that of the second radius blade; and a fourth radius blade having a radiused profile and an effective cutting diameter less than that of the third radius blade.

* * * * *